US006793158B2

(12) United States Patent
Ricco

(10) Patent No.: US 6,793,158 B2
(45) Date of Patent: Sep. 21, 2004

(54) INTERNAL COMBUSTION ENGINE FUEL INJECTOR

(75) Inventor: Mario Ricco, Casamassima (IT)

(73) Assignee: C.R.F. Societa Consortile Per Azioni, Orbassano (IT)

( * ) Notice: Subject to any disclaimer, the term of this patent is extended or adjusted under 35 U.S.C. 154(b) by 0 days.

(21) Appl. No.: 10/271,503

(22) Filed: Oct. 15, 2002

(65) Prior Publication Data

US 2003/0111547 A1 Jun. 19, 2003

(30) Foreign Application Priority Data

Oct. 12, 2001 (IT) ..... TO2001A0970

(51) Int. Cl.[7] ..... B05B 1/34

(52) U.S. Cl. ..... 239/533.1; 239/533.8; 239/585.1

(58) Field of Search ..... 239/533.1, 533.3, 239/533.8, 533.9, 533.15, 585.1, 585.5; 251/129.18, 129.16, 129.21; 123/470

(56) References Cited

U.S. PATENT DOCUMENTS 4,342,427 A 8/1982 Gray
5,154,350 A * 10/1992 Ausiello et al. ..... 239/96
5,775,301 A 7/1998 Ganser
5,937,887 A 8/1999 Baxter et al.
5,984,264 A * 11/1999 Ricco ..... 251/129.16
6,126,094 A * 10/2000 Ricco ..... 239/585.1
6,293,254 B1 9/2001 Crofts et al.
6,443,132 B1 * 9/2002 Ricco et al. ..... 123/467
6,619,617 B2 * 9/2003 Ricco et al. ..... 251/129.16

FOREIGN PATENT DOCUMENTS

EP 0 296 628 A2 12/1988
EP 0 915 251 A2 5/1999
EP 1 111 231 A2 6/2001

* cited by examiner

*Primary Examiner*—Michael Mar
*Assistant Examiner*—Thach H Bui
(74) *Attorney, Agent, or Firm*—Morgan & Finnegan, LLP

(57) ABSTRACT

A fuel injector has a fuel inlet, and a metering valve which is activated by an electromagnetic actuator to open and close an injection nozzle; the metering valve has a control chamber communicating with the inlet and defined by an end wall, in which is formed an outlet hole closed by a shutter moved along an axis by the actuator; the end wall and the shutter are defined by respective parallel, facing surfaces which rest against each other to compress the film of fuel issuing from the hole during closure by the shutter, and which have channeling formed about the hole to generate, in use, a counterpressure for the outflowing fuel.

19 Claims, 2 Drawing Sheets

INTERNAL COMBUSTION ENGINE FUEL INJECTOR

The present invention relates to an internal combustion engine fuel injector.

BACKGROUND OF THE INVENTION

Known injectors comprise an injector body, which defines a nozzle for injecting the fuel into the engine, and houses a metering valve activated by an electromagnetic actuator to open and close the nozzle. The valve comprises a control chamber communicating with a fuel inlet and defined by an end wall having a calibrated outlet hole; and a movable shutter, which is activated by the actuator to mate in fluidtight manner with the end wall and close the calibrated hole to vary the pressure in the control chamber.

More specifically, the shutter engages a conical seat defined by an end portion of the calibrated hole, and provides for fluidtight sealing along a circular contact line.

Known fuel injectors of the above type are unsatisfactory, not only on account of the difficulty and expense of machining the conical seat to the necessary roughness and tolerance values, but more importantly on account of the relatively severe wear to which the shutter and the end wall are subjected along the circular contact line where fluidtight sealing should be ensured. Such wear is substantially due to the relatively high operating speed of the shutter, which normally tends to exert severe, rapid closing forces along the circular contact line, thus resulting in impact which tends to cut into the conical seat.

To eliminate the latter drawback, injectors are known in which the end wall and the shutter mate in fluidtight manner along respective facing, parallel, complementary contact surfaces to close the calibrated hole.

Known solutions of the above type, however, call for relatively high lift of the shutter with respect to the end wall, and therefore relatively large, high-cost actuators requiring relatively high electric control currents. And despite this, wear along the contact surfaces is still relatively severe, by the high lift of the shutter still resulting in impact on the end wall.

The need for a relatively high lift is due to the formation, in use, of vortex regions in the fuel discharging from the calibrated hole, and therefore cavitation caused by the considerable difference in pressure between the calibrated hole and the outside. Which cavitation causes part of the fuel to pass from the liquid to the vapor phase, thus reducing fuel outflow from the calibrated hole, so that the discharge coefficients, and therefore the flow section between the end wall and the shutter, must be maintained high.

SUMMARY OF THE INVENTION

It is an object of the present invention to provide an internal combustion engine injector designed to provide a straightforward, low-cost solution to the above problems.

According to the present invention, there is provided a fuel injector for an internal combustion engine; the injector comprising a fuel inlet; actuating means; and a metering valve activated by said actuating means to open and close an injection nozzle, and comprising a control chamber communicating with said inlet and defined by an end wall having a hole permitting fuel outflow from said control chamber, a shutter activated by the actuating means to move along a longitudinal axis with respect to said end wall, and mating means for mating said shutter and said end wall to close said hole in fluidtight manner; said mating means comprising a first and a second surface carried by said shutter and said end wall respectively, and which extend about said hole facing and parallel to each other, and mate by resting one on the other; characterized in that said mating means also comprise channeling means formed about said hole in at least one of said first and second surfaces.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
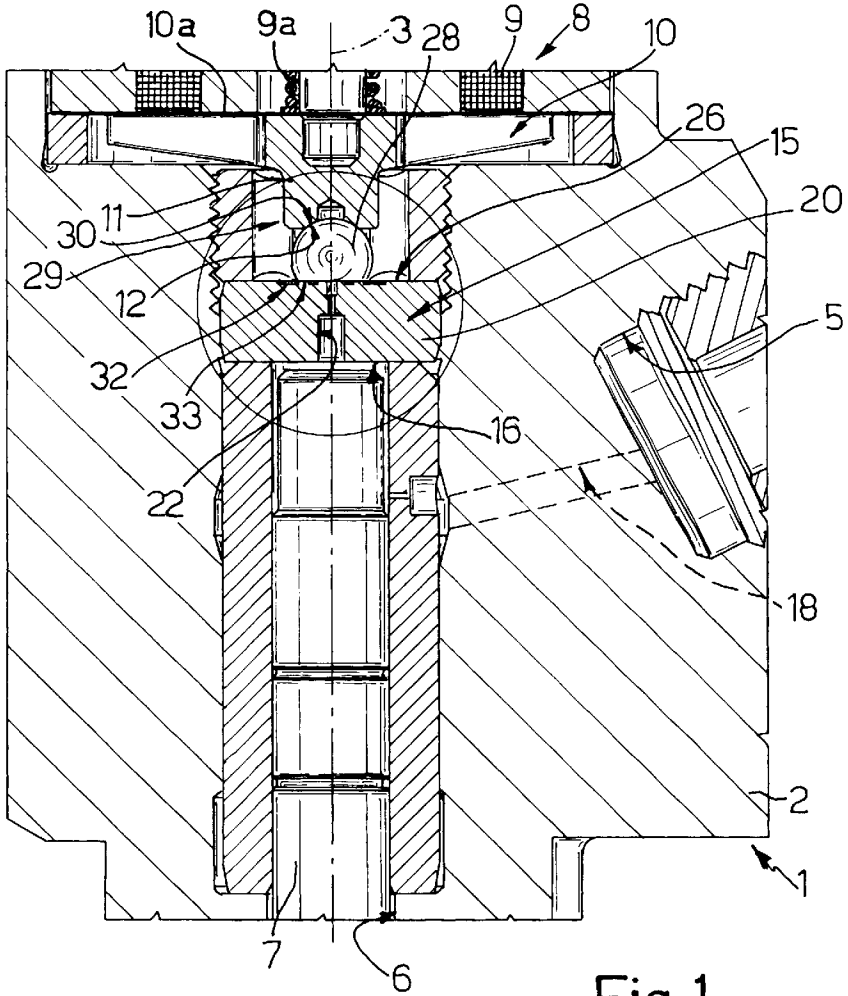
FIG. 1 shows a cross section of part of a preferred embodiment of the internal combustion engine injector according to the present invention.

Number 1 in FIG. 1 indicates as a whole a fuel injector for an internal combustion engine, in particular a diesel engine (not shown).

Injector 1 (shown partly) comprises an outer structure or casing 2, which extends along a longitudinal axis 3, has a lateral inlet 5 for connection to a pump forming part of a fuel supply system (not shown), and terminates with a nozzle (not shown) communicating with inlet 5 and for injecting fuel into a respective engine cylinder.

Casing 2 defines an axial seat 6, and houses a rod 7 which slides axially in fluidtight manner inside seat 6 to control a pin-type shutter (not shown) for closing and opening the fuel injection nozzle. Casing 2 also houses an electromagnetic actuator 8 coaxial with rod 7 and comprising an electromagnet 9 (shown partly), a preloaded push spring 9*a* (shown partly), and an armature 10, which slides axially inside seat 6 and is connected to casing 2 by an elastic locating plate 10*a* interposed axially between electromagnet 9 and armature 10. On the opposite axial side to electromagnet 9, armature 10 terminates with an axial projection 11 defined, at the end, by a spherical concave surface 12 whose center (not shown) lies along axis 3.

Casing 2 also houses a fuel metering valve 15, which is interposed between actuator 8 and rod 7, is activated by actuator 8 to move rod 7 axially, and comprises an axial control chamber 16 communicating permanently with inlet 5 via a passage 18 to receive pressurized fuel. Chamber 16 is defined axially, on one side, by rod 7 and, on the other, by an end wall 20, which is defined by a plate housed in seat 6, is fitted in fluidtight manner and in a fixed position to casing 2, and has an axial outlet hole 22.

Figure 3:
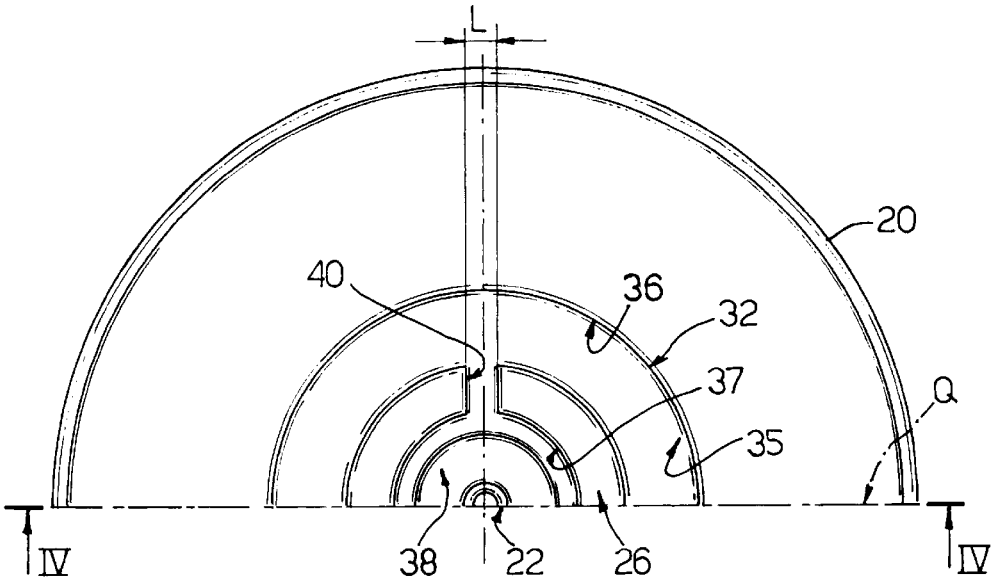
FIG. 3 shows a larger-scale plan view of a detail of the FIGS. 1 and 2 injector.

Hole 22 comprises a calibrated-section, intermediate portion 23 of a diameter D1 preferably ranging between 0.24 and 0.25 millimeters, and two opposite end portions 24, 25; portion 24 is larger in diameter, and comes out inside chamber 16; while portion 25 has a diameter D2 preferably ranging between 0.60 and 0.80 millimeters, and comes out through a flat surface 26 perpendicular to axis 3. FIG. 3 shows a plan view of half of surface 26, the other half of which is symmetrical with respect to a diametrical plane indicated Q in FIG. 3.

Figure 2:
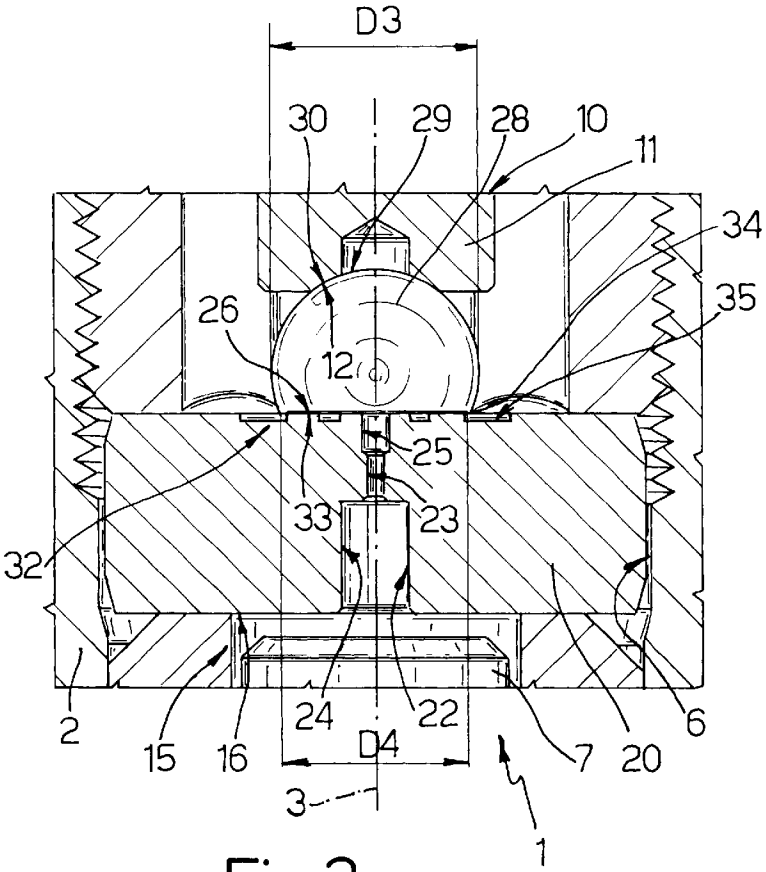
FIG. 2 shows a larger-scale detail of FIG. 1.

As shown in FIG. 2, valve 15 also comprises a shutter 28, which is defined by a substantially spherical body of a diameter D3 preferably ranging between 2.80 and 3.50 millimeters, is interposed between actuator 8 and wall 20, is movable axially with respect to armature 10 and wall 20, and mates with by resting against projection 11 by means of a spherical joint 29.

Joint 29 comprises surface 12; and a spherical surface 30 defining shutter 28, complementary with surface 12, and mating in sliding manner with surface 12.

Shutter 28 mates in fluidtight manner with wall 20 by means of a mating device 32 comprising surface 26, and a flat surface 33 which defines a flat lateral portion of shutter 28, has a circular edge 34 of a diameter D4 preferably ranging between 2.60 and 2.80 millimeters, and is parallel to and faces surface 26.

Figure 4:
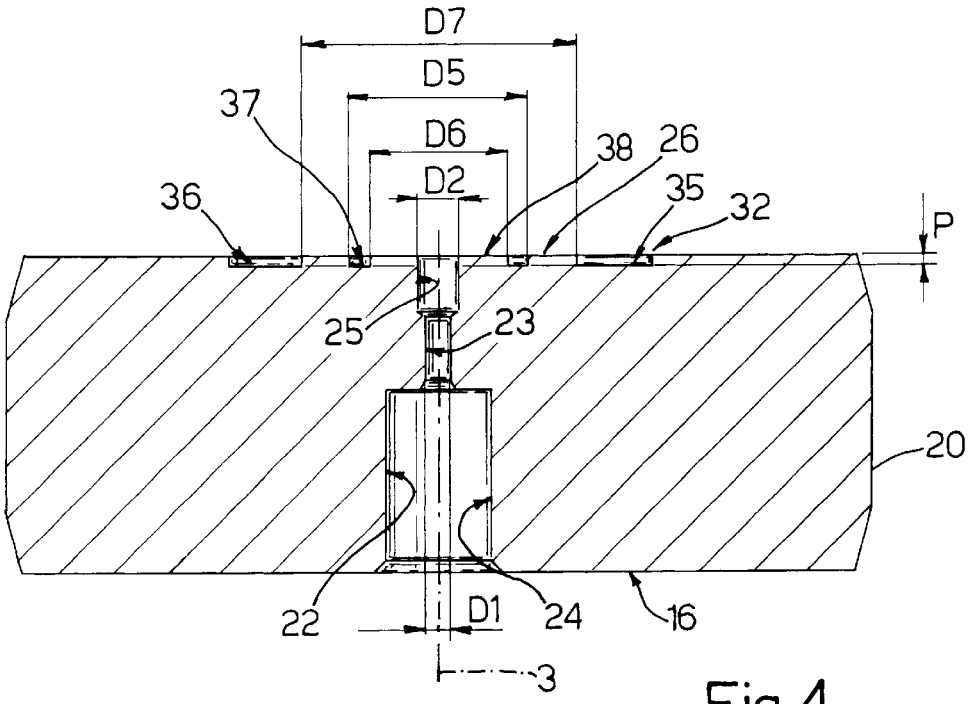
FIG. 4 shows a section along line IV—IV in FIG. 3.

With reference to FIGS. 2, 3 and 4, device 32 also comprises channeling 35, which is formed in wall 20, along surface 26, is of a depth P preferably ranging between 0.08 and 0.15 millimeters, and in turn comprises a circular outer groove 36 and a circular inner groove 37 formed coaxially with each other about axis 3 and therefore about hole 22. Groove 37 has an outside diameter D5 preferably ranging between 1.20 and 1.50 millimeters, and an inside diameter D6 preferably ranging between 0.90 and 1.20 millimeters, and surrounds a flat annular area 38 forming part of surface 26 and extending about portion 25 of hole 22. Groove 36, on the other hand, has an outside diameter greater than diameter D4 and preferably ranging between 3.20 and 3.40 millimeters, and an inside diameter D7 smaller than diameter D4 and preferably ranging between 2.20 and 2.40 millimeters.

Channeling 35 also comprises two diametrically opposite radial channels 40 (FIG. 3), which connect grooves 36 and 37, have a passage section preferably ranging between 0.016 and 0.060 square millimeters, and are of a radial length equal to (D7–D5)/2 and preferably ranging between 0.35 and 0.60 millimeters. Channels 40 are therefore of a width L, measured tangentially to axis 3, preferably ranging between 0.20 and 0.40 millimeters.

In actual use, when the axial thrust of spring 9*a* causes shutter 28 to close hole 22, portion 24 of hole 22 and chamber 16 contain fuel at an operating pressure of 300 to 1600 bars and equal, for example, to roughly 1000 bars to close the nozzle of injector 1.

When electromagnet 9 is activated, armature 10 withdraws from wall 20, but the fuel pressure in portion 25 exerts sufficient axial thrust on shutter 28 to keep shutter 28 resting against projection 11, so that hole 22 opens, thus reducing the pressure in chamber 16 and so opening the injection nozzle.

During the time hole 22 is open, part of the fuel issues from hole 22 towards groove 36 in the form of a film inside a gap defined by surfaces 26 and 33, and then out along a recirculating conduit (not shown) of injector 1.

When electromagnet 9 is again deactivated, spring 9*a* exerts axial thrust on armature 10, so that shutter 28 compresses the fuel film between surfaces 26 and 33 and then closes hole 22. As shutter 28 closes, compression of the fuel film acts as a damper preventing shutter 28 from striking and rebounding against wall 20. At the same time, the pressure of the fuel in groove 36 substantially equals the atmospheric pressure outside, while the pressure of the fuel in groove 37 settles between 50 and 100 bars, and defines, for the fuel issuing from hole 22, a counterpressure which reduces the spinning motion of the fuel in hole 22 and, therefore, the risk of local cavitation.

Once shutter 28 contacts wall 20, area 38 resting on surface 33 ensures fluidtight sealing about hole 22, while edge 34 extends at groove 36 and therefore leaves no impressions or incisions on wall 20, which is normally made of softer material than shutter 28.

Channeling 35 therefore reduces the risk of cavitation of the fuel issuing from hole 22, by virtue of the counterpressure generated in groove 37. The fuel therefore remains permanently in the liquid phase; the discharge coefficients from chamber 16 through hole 22 are high as compared with known solutions with no channeling 35; chamber 16 empties relatively quickly; and, as compared with known solutions, the lift of shutter 28 may be set to extremely low values, e.g. roughly 0.03 millimeters.

Reducing lift reduces the axial gap between the core of electromagnet 9 and armature 10 when electromagnet 9 is energized, so that magnetic flux and the magnetic forces of attraction are relatively high, thus enabling use of a small, fast-operating, low-control-current, and therefore low-cost, electromagnet 9.

Also by virtue of the strong magnetic forces of attraction (e.g. about 70 newtons), a relatively large shutter 28 can be used to increase surface 33 and the damping forces between surfaces 26 and 33 produced by compressing the fuel.

By increasing the magnetic forces of attraction, the preload of spring 9*a*, when assembling injector 1, can be set to relatively high values, e.g. 60 newtons (as opposed to 30 newtons, as in known solutions), so as to obtain relatively high thrust forces and so reduce the downtime of armature 10 when electromagnet 9 is deactivated to close hole 22.

By increasing the thrust exerted by spring 9*a*, plate 10*a* can be made of ferromagnetic material, stronger than the nonmagnetic material normally used in known solutions, and with a strong, ample structure to cover as much as 80% of the surface of electromagnet 9 affected by the magnetic flux, with substantially no delay in detachment of armature 10 from the core of electromagnet 9.

Compressing the fuel film issuing from hole 22 when shutter 28 moves towards wall 20 greatly reduces wear of shutter 28 and wall 20 at surfaces 26, 33. As stated, wear of injector 1 is also reduced by forming edge 34 about the inner edge of groove 36, while the shape and size of channels 40 stabilize the pressure in groove 37 and so reduce turbulence and the risk of cavitation as the fuel issues from hole 22.

The geometry of channeling 35 and, in particular, the size of channels 40 also provide for achieving the desired counterpressure values.

At the same time, the pressure of the fuel and the shape and size of hole 22, of shutter 28, and of channeling 35 improve fuel discharge conditions, and generate a hydraulic force which keeps shutter 28 permanently contacting projection 11, thus preventing shutter 28 from impacting and rebounding on armature 10. Any impact or rebound of shutter 28 on armature 10 or wall 20 would result in severe wear, thus resulting in an undesired increase in the lift of shutter 28 and therefore in fuel flow from chamber 16.

Joint 29 keeps surfaces 26 and 33 parallel automatically, and regardless of any error or inaccuracy in the assembly or machining of the various component parts of injector 1.

Being flat, surfaces 26 and 33 can be machined cheaply and easily to the precision required to ensure fluidtight sealing about hole 22, and the fact that shutter 28 is axially movable with respect to armature 10 simplifies machining of projection 11 by eliminating the need for axial retaining devices.

Clearly, changes may be made to injector 1 as described and illustrated herein without, however, departing from the scope of the present invention.

In particular, the shutter of valve 15 may be other than as described and illustrated by way of example, and/or device 32 may comprise other than perfectly flat mating surfaces, but still facing and parallel to each other to define a gap for housing a fuel film acting as a hydraulic damper.

Joint 29 interposed between actuator 8 and the shutter of valve 15 may be other than as shown and, for example, separate from the shutter.

Finally, the channeling of device 32 may be shaped and sized differently from channeling 35 described herein, or may be formed at least partly along surface 33, but still about hole 22, to generate, in use, a counterpressure for the fuel issuing from hole 22.

What is claimed is:

1. A fuel injector for an internal combustion engine; the injector comprising a fuel inlet; actuating means; and a metering valve activated by said actuating means to open and close an injection nozzle, and comprising a control chamber communicating with said inlet and defined by an end wall having a hole permitting fuel outflow from said control chamber, a shutter activated by the actuating means to move along a longitudinal axis with respect to said end wall, and mating means for mating said shutter and said end wall to close said hole in fluidtight manner; said mating means comprising a first and a second surface carried by said shutter and said end wall respectively, and which extend about said hole facing and parallel to each other, and mate by resting one on the other; characterized in that said mating means also comprise channeling means formed about said hole in at least one of said first and second surfaces.

2. An injector as claimed in claim 1, characterized in that said channeling means comprise at least a first annular groove extending continuously about said hole.

3. An injector as claimed in claim 2, characterized in that said first annular groove is a circular groove.

4. An injector as claimed in claim 2, characterized in that said first annular groove is coaxial with said hole.

5. An injector as claimed in claim 2, characterized in that said channeling means also comprise a second annular groove formed in one of said first and second surfaces; said first annular groove being formed in an intermediate radial position between said second annular groove and said hole.

6. An injector as claimed in claim 5, characterized in that said channeling means also comprise at least one channel formed in one of said first and second surfaces to connect said first and said second annular groove.

7. An injector as claimed in claim 6, characterized in that said channeling means comprise two diametrically opposite said channels formed in said second surface.

8. An injector as claimed in claim 6, characterized in that said channel has a passage section preferably ranging between 0.016 and 0.060 square millimeters, and is of a radial length ranging between 0.35 and 0.60 millimeters.

9. An injector as claimed in claim 5, characterized in that said second annular groove is formed in said second surface; said first surface being defined by an outer annular edge extending at said second annular groove.

10. An injector as claimed in claim 2, characterized in that the inside diameter of said first annular groove ranges between 0.90 and 1.20 millimeters.

11. An injector as claimed in claim 2, characterized in that the outside diameter of said first annular groove ranges between 1.20 and 1.50 millimeters.

12. An injector as claimed in claim 1, characterized in that the depth of said channeling means ranges between 0.08 and 0.15 millimeters.

13. An injector as claimed in claim 1, characterized by also comprising articulated joint means interposed between said shutter and said actuating means.

14. An injector as claimed in claim 13, characterized in that said actuating means comprise a movable actuating member for pushing said shutter towards said second surface; said shutter and said movable actuating member being movable axially with respect to each other.

15. An injector as claimed in claim 14, characterized in that said articulated joint means comprise two complementary spherical surfaces mating in sliding manner with each other, and of which one defines said movable actuating member, and the other said shutter.

16. An injector as claimed in claim 1, characterized in that said first and said second surface are flat and perpendicular to said longitudinal axis.

17. An injector as claimed in claim 1, characterized in that said hole comprises an intermediate portion of a diameter ranging between 0.24 and 0.25 millimeters, and an end portion which comes out through said second surface and has a diameter ranging between 0.60 and 0.80 millimeters.

18. An injector as claimed in claim 1, characterized in that said shutter is defined by a spherical body having a flat lateral portion.

19. An injector as claimed in claim 18, characterized in that said spherical body has a diameter ranging between 2.80 and 3.50 millimeters.

* * * * *